United States Patent [19]

Staerzl

[11] Patent Number: 4,714,067

[45] Date of Patent: Dec. 22, 1987

[54] ELECTRONIC FUEL INJECTION CIRCUIT WITH ALTITUDE COMPENSATION

[75] Inventor: Richard E. Staerzl, Fond du Lac, Wis.

[73] Assignee: Brunswick Corporation, Skokie, Ill.

[21] Appl. No.: 946,189

[22] Filed: Dec. 23, 1986

[51] Int. Cl.[4] ..... F02D 41/34

[52] U.S. Cl. ..... 123/494; 123/412; 123/478

[58] Field of Search ..... 123/412, 478, 488, 494, 123/440, 489

[56] References Cited

U.S. PATENT DOCUMENTS

| | | | |
|---|---|---|---|
| 4,271,797 | 6/1981 | McCarbery | 123/412 |
| 4,280,465 | 7/1981 | Staerzl | 123/494 |
| 4,349,000 | 9/1982 | Staerzl | 123/491 |
| 4,526,148 | 7/1985 | Narasaka et al. | 123/494 X |

*Primary Examiner*—Tony M. Argenbright

*Attorney, Agent, or Firm*—Hopgood, Calimafde, Kalil, Blaustein & Judlowe

[57] ABSTRACT

A resistance switching circuit is toggled immediately prior to cranking but subsequent to power application by the output of a manifold absolute pressure sensor effectively responding to ambient atmospheric pressure as indicative of altitude. The switching circuit is connected in series with the resistance element of the potentiometer which serves as the throttle control and alters the transfer characteristic of the control circuit. The gain of the system is such that the output operational amplifier saturates at an intermediate throttle setting such that the response for slow throttle is y=nx over the entire range of manifold pressure, while for fast throttle the response is y=nx for low manifold pressure and changes to y=mx+b for higher manifold pressure.

9 Claims, 4 Drawing Figures

ELECTRONIC FUEL INJECTION CIRCUIT WITH ALTITUDE COMPENSATION

BACKGROUND OF THE INVENTION

The present invention relates to a potentiometer-type throttle for an electronic fuel-injection control circuit for an internal-combustion engine of the type described in my U.S. Pat. No. 4,349,000, issued Sept. 14, 1982. Reference is made to said patent for greater descriptive detail of a fuel injection engine to which the present invention is illustratively applicable.

In all internal-combustion engine fuel control systems, the objective is to control the fuel-air mixture so that, within the limits of the particular system, it will be optimum for extracting maximum power with minimum fuel consumption. The control circuit described in my said patent makes use of sensors arranged to measure or ascertain both manifold absolute pressure and manifold absolute temperature to provide a signal indicative of the air mass entering the engine during any particular incremental interval. However, differences in air density at different altitudes, and concurrent changes in exhaust back pressure due to the changes in altitude-determined ambient air pressure cause prior systems to deviate from optimum efficiency.

SUMMARY OF THE INVENTION

It is, therefore, an object of the present invention to provide an arrangement for controlling the fuel flow to match the engine air flow taking into account changes in ambient air parameters with altitude.

A further object is to provide means for modifying the control circuit as previously known so as to take into consideration changes in ambient air parameters with altitude.

In accordance with the present invention there is provided in an electronic fuel-injection control circuit for an internal-combustion engine, wherein a manifold absolute pressure sensor and a manifold absolute temperature sensor feed signals through a combining network to the resistance element of a potentiometer having a variable tap from which a control voltage is derived as a function of desired throttle setting, the improvement wherein compensation means are provided coupled to said potentiometer for altering the relationship between said control voltage and said manifold absolute pressure sensor signal as a function of ambient atmospheric pressure.

BRIEF DESCRIPTION OF THE DRAWINGS

The invention will be better understood after reading the following detailed description of the presently preferred embodiments thereof with reference to the appended drawings in which.

The same reference numerals are used throughout the drawings to designate the same or similar parts.

DETAILED DESCRIPTION OF THE PRESENTLY PREFERRED EMBODIMENT

Figure 1:
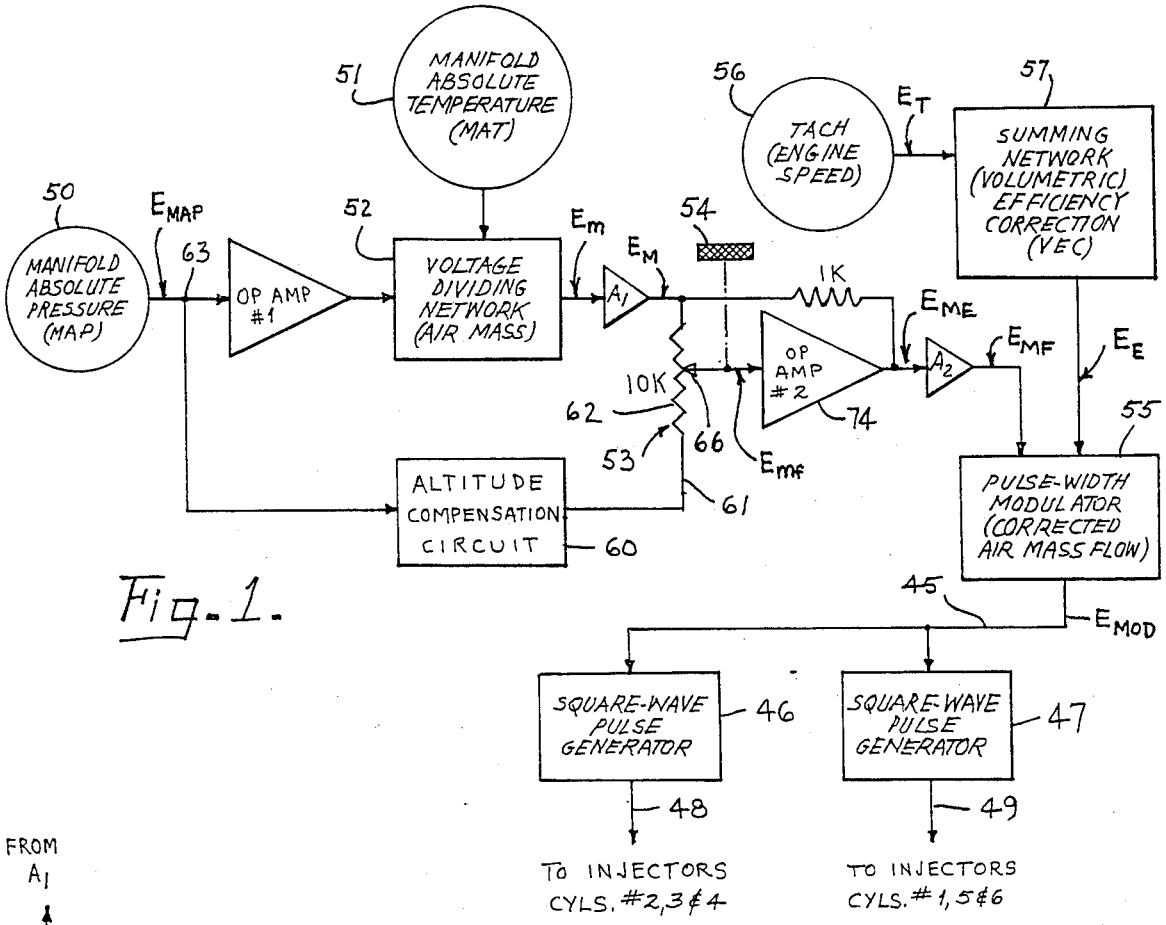
FIG. 1 is an electrical block diagram schematically indicating the components of a fuel-injection control circuit embodying the present invention.

In my above-identified patent, a fuel-injection internal-combustion engine is described in which one or more square-wave pulse generators drive solenoid-operated injectors unique to each cylinder, there being a single control system whereby the pulse-generator means is modulated as necessary to accomodate throttle demands in the context of engine speed and other factors. FIG. 1 herein is adopted from said patent for purposes of simplified contextual explanation.

The control system of FIG. 1 is shown in illustrative application to a two-cycle six-cylinder 60-degree V-engine wherein injectors for cylinders #2, #3 and #4 are operated simultaneously and (via line 48) under the control of the pulse output of a first square-wave generator 46, while the remaining injectors (for cylinder #5, #6 and #1) are operated simultaneously and (via line 49) under the control of the pulse output of a second square-wave generator 47. The base or crankshaft angle for which pulses generated at 46 are timed is determined by ignition-firing at cylinder #1, and pulses generated at 47 are similarly based upon ignition-firing at cylinder #4, i.e. at 180 crankshaft degrees from cylinder #1 firing. The actual time duration of all such generated pulses will vary in response to a control signal, supplied over line 45 to both generators 46 and 47.

The circuit to produce the modulating voltage operates in response to various input parameters in the form of analog voltages which reflect air-mass flow for the current engine speed, and a correction is made for volumetric efficiency of the particular engine. More specifically, for the circuit shown, a first electrical sensor 50 of manifold absolute pressure (MAP) serves as a source of a first voltage $E_{MAP}$ which is linearly related to such pressure, and a second electrical sensor 51 of manifold absolute temperature (MAT), which may be a thermistor which is linearly related to such temperature, serves as a source of a second voltage fed through a resistor network 52. The voltage $E_{MAP}$ is divided by the network 52 and modified by the MAT signal to produce a voltage $E_m$ which is a linear function of instantaneous air mass or density at the air intake of the engine. A first amplifier $A_1$ provides a corresponding output voltage $E_M$ at the high-impedance level needed for regulation-free application to the relatively low impedance of potentiometer 53, having a selectively variable control that is symbolized by a throttle knob 54. The voltage output $E_{mf}$ of potentiometer 53, reflects a "throttle"-positioned pick-off voltage and thus reflects instantaneous air-mass flow, for the instantaneous throttle (54) setting, and a second amplifier $A_2$ provides a corresponding output voltage $E_{MF}$ for regulation-free application to one of the voltage-multiplier inputs of a pulse-width modulator 55, which is the source of $E_{MOD}$ already referred to.

The other voltage-multiplier input of modulator 55 receives an input voltage $E_E$ which is a function of engine speed and volumetric efficiency. More specifically, a tachometer 56 generates a voltage $E_T$ which is linearly related to engine speed (e.g., crankshaft speed, or repetition rate of one of the spark plugs), and a summing network 57 operates upon the voltage $E_T$ and certain other factors (which may be empirically determined, and which reflect volumetric efficiency of the particular engine size and design) to develop the voltage $E_E$ for the multiplier of modulator 55.

Figure 3:
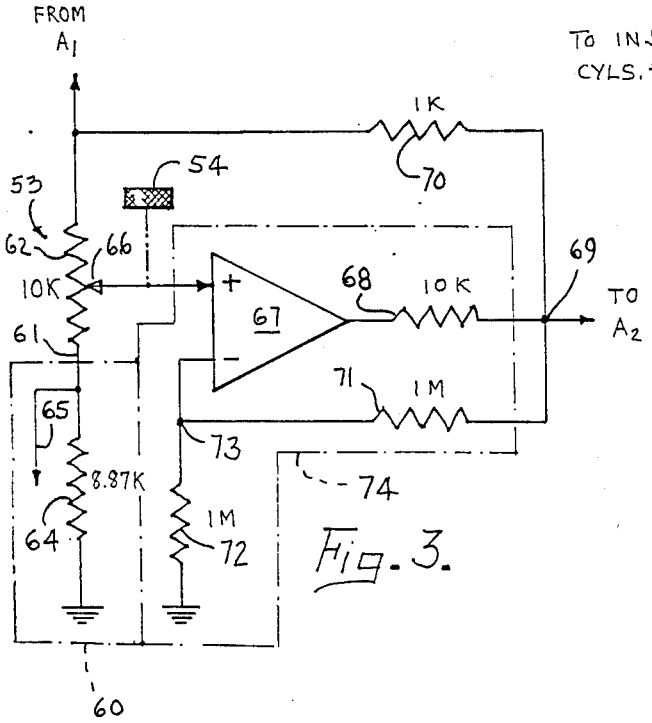
FIG. 3 is an electrical schematic diagram of the operational amplifier (OP AMP) #2 forming a part of the circuit shown in FIG. 1.

In order to provide compensation for changes in air parameters at the altitude at which the engine is operating, an altitude compensation circuit 60 is connected between the end 61 of the resistance element 62 of potentiometer 53, and the output of the sensor 50 at junction 63. Before describing the details of construction of the compensation circuit 60, reference should be had to FIG. 3 which shows the compensation circuit 60 as including a resistor 64 connected between ground (point of reference potential) and the end 61 of potentiometer element 62. The arrowheaded lead line 65 merely indicates connection to the remainder of the compensation circuit. For the moment it is sufficient to be aware that the resistor 64, by the connection 65, is selectively shunted by an array of different resistors. The potentiometer slider 66, connected to the throttle control 54, is electrically connected to the direct input of an operational amplifier 67, the output of which is connected through a resistor 68 to a junction 69 which leads to amplifier $A_2$. A resistor 70, seen also in FIG. 1, connects the junction 69 back to the output of amplifier $A_1$ while a voltage divider consisting of resistors 71 and 72 is connected to ground from junction 69, and the junction 73 between resistors 71 and 72 is connected to the inverting input of operational amplifier 67. The components of FIG. 3 within the phantom outlined box 74 are represented in FIG. 1, as OP AMP #2.

Figure 2:
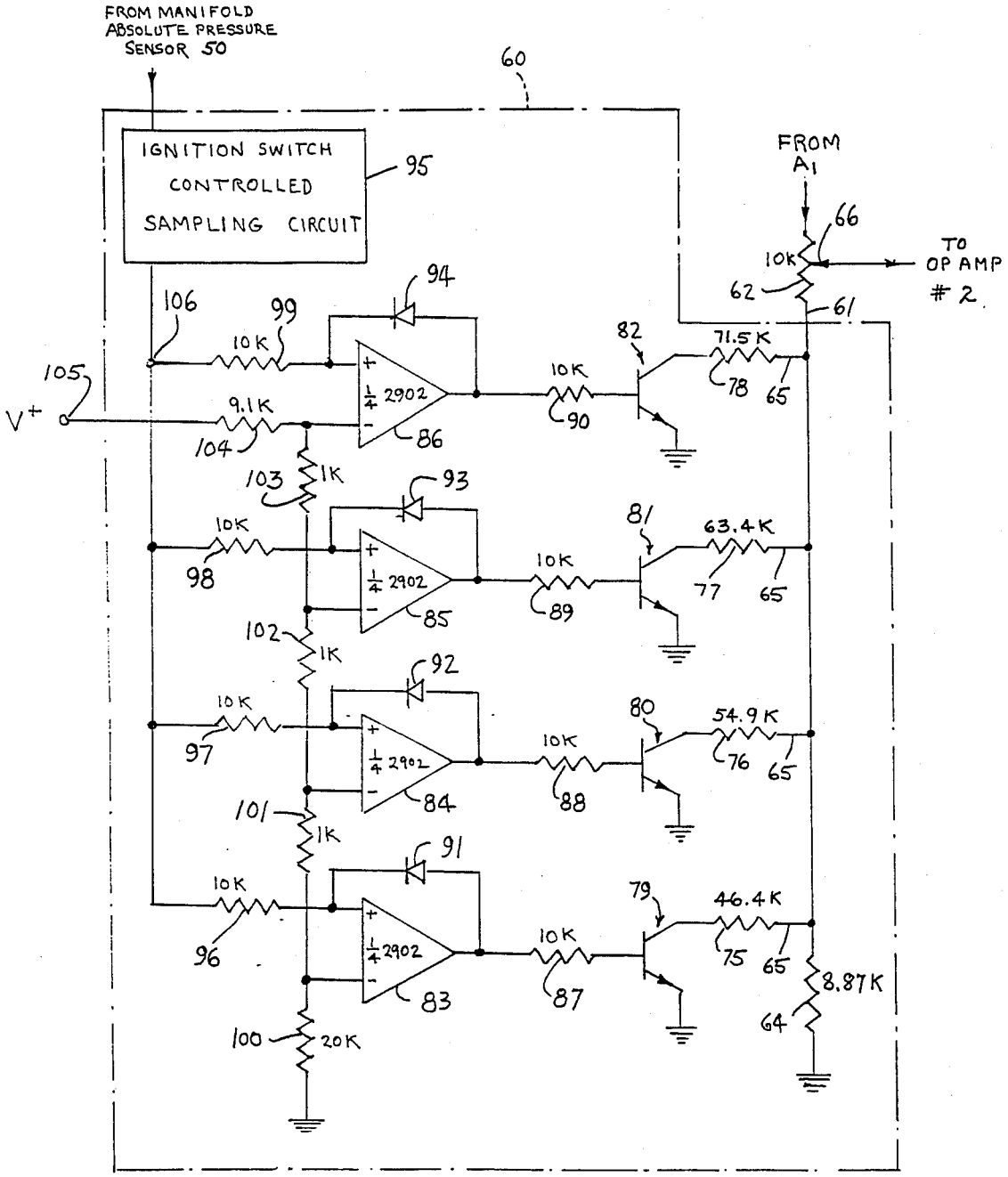
FIG. 2 is an electrical schematic diagram of the altitude compensation circuit shown in block form in FIG. 1.

Now, referring to FIG. 2, the details of the compensation circuit are shown. Four resistor 75, 76, 77 and 78, each in series with a corresponding transistor 79, 80, 81 and 82, respectively, are connected in parallel with resistor 64 between ground and resistance element 62. Four operational amplifiers 83, 84, 85 and 86 have their outputs connected, respectively, through resistors 87, 88, 89 and 90 to the base electrodes of transistors 79 to 82. Each operational amplifier 83 to 86 has a corresponding diode 91, 92, 93 and 94 coupled from the amplifier output back to the direct input, as shown. Input to the direct inputs of amplifiers 83 to 86 is derived from the manifold absolute pressure sensor 50 through an ignition switch controlled sampling circuit 95 and respective resistors 96, 97, 98, 99. Input to the indirect inputs of amplifiers 83 to 86 is derived from a voltage divider consisting of series connected resistors 100, 101, 102, 103 and 104 connected between ground and a positive voltage source at terminal 105.

The values of the various resistors are shown in conventional manner on the various figures of the drawings. Also, operational amplifiers 83 to 86 may be provided by the four sections of a quad component type 2902.

Ignition switch controlled sampling circuit 95 can take any convenient form for supplying power to the compensation circuit 60 when the ignition switch is turned ON and for temporarily connecting all of the resistors 96, 97, 98 and 99, at junction 106 to the voltage from MAP sensor 50. This connection to sensor 50 should be established before actual cranking of the engine and at least before the manifold pressure has dropped below ambient atmospheric pressure. The operational amplifiers 83 to 86 will then operate as voltage-dependent latching comparators to establish a "high" output if the corresponding direct input exceeds the level set at the inverse input from the voltage divider 100 to 104. The arrangement is such that at sea level all amplifiers 83 to 86 are switched to a "high" output causing all transistors 79 to 82 to conduct placing resistors 75 to 78 simultaneously in shunt with resistor 64.

At a MAP pressure corresponding to an altitude of about 1550 ft., resistor 75 remains out of the circuit with transistor 79 non-conducting and the output of amplifier 83 "low". At an altitude of approximately 3100 ft., both transistors 79 and 80 are non-conducting, resistors 75 and 76 being both open-circuited. At about 4650 ft., resistor 77 also becomes open-circuited, while at about 6200 ft. all four resistors, 75 to 78, are open-circuited.

Figure 4:
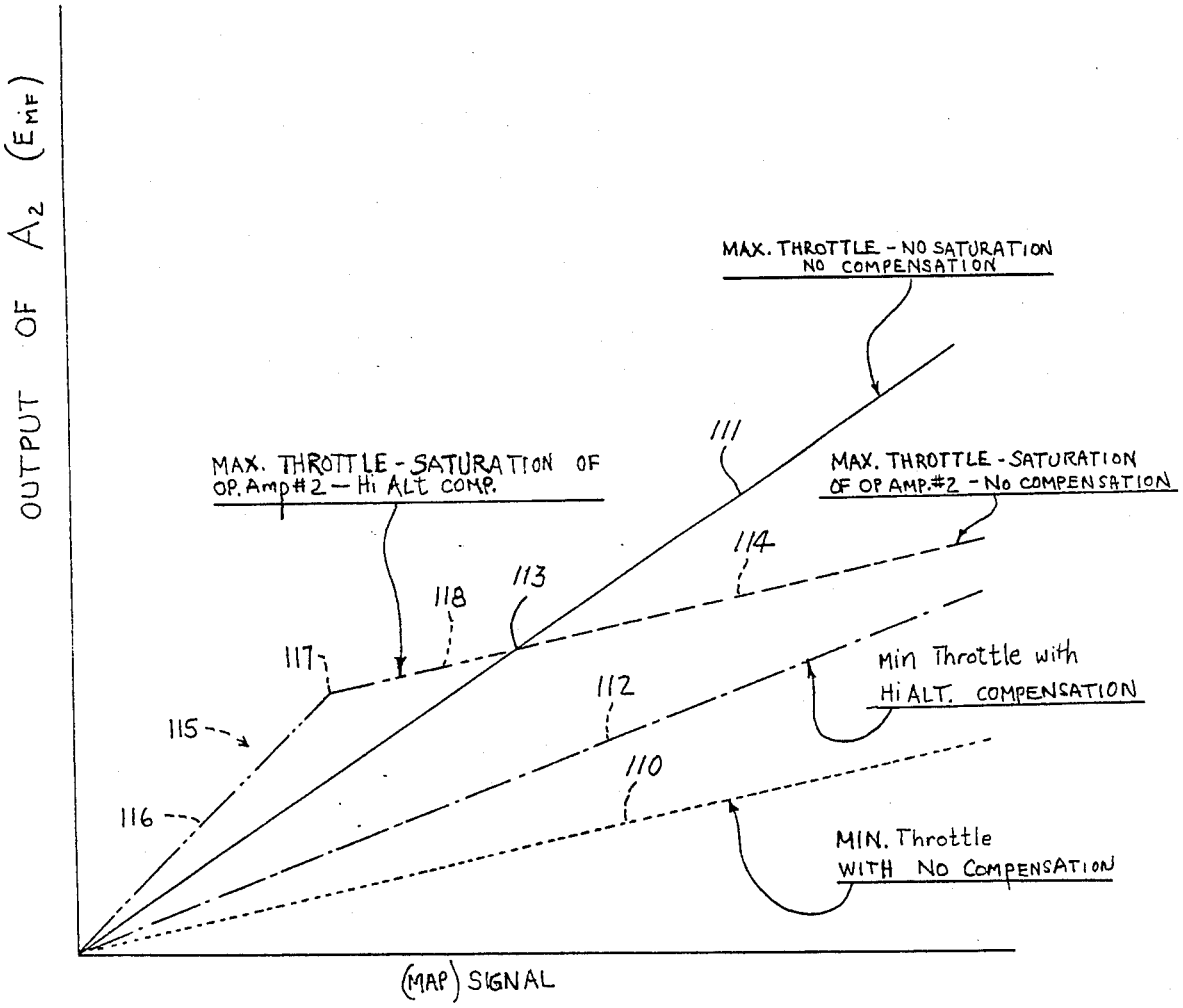
FIG. 4 is a graphical representation of the operation of the circuit of FIG. 1 illustrating for various conditions the relationship between an output signal, ($E_{MF}$), the output of amplifier $A_2$, and the manifold absolute pressure (MAP) signal.

The effect on system operation is best illustrated by the curves of FIG. 4. The straight but broken line 110 shows the linear relationship between the output voltage $E_{MF}$ from amplifier $A_2$ and the MAP signal $E_{MAP}$ at junction 63 when the throttle is at minimum setting and no compensation is provided. The solid line 111 shows the reponse for maximum throttle, again with no compensation, but assuming that none of the operational amplifiers is driven to saturation. The curves are not plotted to any particular scale and are intended only to indicate the relative relationships.

The broken line curve 112, also a straight line, illustrates the influence of superimposing some measure of high altitude compensation on the control represented by curve 110, that is, on the curve representing response to minimum throttle setting. As shown, introducing compensation (one or more of the resistors 75 to 78 being open-circuited) will increase the slope of the response curve although the curve will still have the form representable by $y=nx$ where y is the control voltage $E_{MF}$ at the output of amplifier $A_2$, x is the manifold absolute pressure signal voltage from sensor 50, and n has a value that is a function of the number of said resistors 75 to 78 that are open-circuited and, therefore, varies as a function of altitude.

At minimum throttle setting the voltage fed from potentiometer slider 66 to the operational amplifier 74 is not of such magnitude as to cause saturation of amplifier 74. However, as the throttle control 54 is advanced toward maximum throttle setting a point will be reached at which amplifier 74 will become saturated causing its output to flatten out even though the MAP signal continues to increase. The present control system is designed such that with no altitude compensation the operational amplifier 74 will be driven to saturation when the throttle control 54 has been rotated through about one-half of its total range of travel. Consequently, instead of the curve remaining of the form $y=nx$ as represented by line 111, the curve will have a knee or break at 113 and will follow, above the knee 113, the dashed line 114 for larger MAP signals, Thus, the curve over the dashed line section 114 will be of the form $y=mx+b$ where y and x are as defined above, b is the intercept on the y axis if the curve were to be extended to the left, and m is the slope. Both b and m are substantially constant over the range of altitude compensation afforded by the circuit. Of course, to the left of the knee 113, the response remains of the form $y=nx$.

Finally, the broken line curve 115 having a section 116 of the form $y=nx$, a knee 117 due to saturation of amplifier 74, and a section 118 of the form $y=mx+b$ where the values of m and b are the same as for curve 114, shows the effect of superimposing altitude compensation upon the response for maximum throttle setting.

Having described the invention with reference to the presently preferred embodiment thereof, it should be understood that various changes in construction will occur to those skilled in the subject art without departing from the true spirit of the invention as defined in the appended claims.

What is claimed is:

1. In an electronic fuel-injection control circuit for an internal-combustion engine, wherein a manifold absolute pressure sensor and a manifold absolute temperature sensor feed signals through a combining network to the resistance element of a potentiometer having a variable tap from which a control voltage is derived as a function of desired throttle setting, the improvement wherein compensation means are provided coupled to said potentiometer for altering the relationship between said control voltage and said manifold absolute pressure sensor signal as a function of ambient atmospheric pressure.

2. An electronic fuel-injection control circuit according to claim 1, wherein said compensation means comprises a circuit connected to both said manifold absolute pressure sensor and said potentiometer resistance element.

3. An electronic fuel-injection control circuit according to claim 1, wherein said compensation means comprises means coupled to said manifold absolute pressure sensor and said potentiometer resistance element for increasing the slope of the response curve relating output signal voltage to manifold absolute pressure signal, said slope being increased in proportion to decrease in said ambient atmospheric pressure.

4. An electronic fuel-injection control circuit according to claim 3, wherein said slope increasing means is related to said combining network such that for small throttle settings said response curve is a substantially straight line of constant slope over the entire range of manifold absolute pressure sensed by said sensor, said slope being directly proportional to altitude.

5. An electronic fuel-injection control circuit according to claim 4, wherein said slope increasing means is related to said combining network such that for throttle settings in excess of some intermediate setting said response curve comprises a first part operative for low manifold absolute pressure signals and a second part operative for manifold absolute pressure signals above a predetermined value, said second part following a substantially straight line corresponding to $y=mx+b$ where y is said control voltage, x is said manifold absolute pressure signal, and b is the intercept on the y axis, b and m being substantially constant over the range of altitude compensation, and said first part following a substantially straight line corresponding to $y=nx$ where y and x are as previously defined and n varies as a function of altitude.

6. An electronic fuel-injection control circuit according to claim 5, wherein said slope increasing means comprises means for altering n stepwise as a function of altitude.

7. An electronic fuel-injection control circuit according to claim 6, wherein said slope stepwise altering means comprises means responsive to the manifold absolute pressure signal at the instant immediately prior to engine cranking.

8. An electronic fuel-injection control circuit according to claim 1, wherein said compensation means comprises a variable resistance network connected in series with said potentiometer resistance element between the latter and a point of reference potential, and means for selecting the resistance of said resistance network from a range of resistance as a function of the manifold absolute pressure existing immediately prior to engine cranking.

9. An electronic fuel-injection control circuit according to claim 8, wherein said variable resistance network comprises a plurality of resistors each in series with a separate voltage controlled switch, the plurality of resistors each having a terminal remote from the corresponding voltage controlled switch which terminals are connected together and to an end of said potentiometer resistance element, a separate voltage comparator circuit coupled in controlling relation to each voltage controlled switch, and an ignition switch controlled sampling circuit interconnecting said manifold absolute pressure sensor with an input of each said comparator circuit.

* * * * *